United States Patent [19]

Riesen

[11] 4,279,133

[45] Jul. 21, 1981

[54] LAYING-IN COMB FOR WARP KNITTING MACHINES

[75] Inventor: Peter Riesen, Elgg, Switzerland

[73] Assignee: Sulzer Brothers Limited, Winterthur, Switzerland

[21] Appl. No.: 146,601

[22] Filed: May 5, 1980

[30] Foreign Application Priority Data

May 18, 1979 [CH] Switzerland ..... 4643/79

[51] Int. Cl.[3] ..... D04B 23/06; D04B 23/08; D04B 23/10; D04B 23/12

[52] U.S. Cl. ..... 66/84 R; 66/203; 66/109

[58] Field of Search ..... 66/203, 104, 109, 214, 66/207, 84 R

[56] References Cited

U.S. PATENT DOCUMENTS

| | | | |
|---|---|---|---|
| 3,512,378 | 5/1970 | Bosse-Platiere | 66/84 |
| 3,699,658 | 1/1970 | Peters | 66/207 X |

*Primary Examiner*—Ronald Feldbaum
*Attorney, Agent, or Firm*—Kenyon & Kenyon

[57] ABSTRACT

The laying-in comb for a warp knitting machine has sinkers wherein the top edges are longitudinally offset relative to the bottom edges so as to impart rigidity to the sinkers. The amount of offset decreases from the securing end of the sinkers towards the head end of the sinkers. The sinkers may be permanently deformed by being cast into a mounting block or may be placed under tension by means of separate blocks which are movable relative to each other. The blocks may also be mounted on bars which are programmed in accordance with a suitable pattern.

14 Claims, 9 Drawing Figures

LAYING-IN COMB FOR WARP KNITTING MACHINES

This invention relates to a laying-in comb for warp knitting machines.

Heretofore, warp knitting machines have been known to have a laying-in comb with sinkers secured on one side and disposed in accordance with the needle spacing of the machines. These machines also have guide bars, for example in the form of guide strips which are disposed in close relation and which are prevented from moving in the swinging direction while weft yarns are being layed-in by the comb. Such machines are described in German Pat. No. 15 85 536. During operation, these machines require a considerable distance between the guide bars or strips and the knocking over-edges of the presser bar. Accordingly, the comb sinkers have to be very high. However, due to the required dimensions, the sinkers have very little lateral stability.

Since the thickness of the sinkers is limited in machines having a small needle spacing, it becomes difficult to lay-in the weft yarns without faults. Also, if the guide bars are shogged over a considerable distance, the tip or head of the sinkers may be bent sideways by the weft yarns. This may result in the weft yarns being layed-in the wrong needle lane. In addition, vibration of the machine or the comb may influence the laterally unstable comb sinkers. This, in turn, reduces the accuracy of the sinker heads.

Further, where the machines have a small needle spacing, the lateral stability of the sinkers cannot be increased by making the sinkers thicker. Also, the rigidity of the sinkers cannot be appreciably increased by raising the height of the sinkers at their securing points to the comb.

Accordingly, it is an object of the invention to increase the lateral stability of thin sinkers in a warp knitting machine.

It is another object of the invention to provide a laying-in comb having sinkers secured thereon in a rigid manner.

Briefly, the invention provides a laying-in comb for a warp knitting machine which has a plurality of spaced apart aligned sinkers. Each sinker has a head at one end, a securing end at the opposite end, a top edge extending between the two ends and a bottom edge longitudinally offset from the top edge at least at the securing end. This offset also decreases from the securing end to the head.

The offset relationship between the top edge of the sinker relative to the bottom edge has an excellent supporting affect which greatly or adequately increases the rigidity of the sinker in the lateral direction.

In one embodiment, each sinker is permanently deformed around an imaginary longitudinal axis. In this case, each sinker may be permanently curved about the axis or permanently bent at an angle about the axis. In this embodiment, the sinker is deformed during manufacture. As noted above, the offset is greatest at the securing point and decreases to approximately zero towards the sinker head.

In another embodiment, each sinker has a centrally located slot extending from the securing end to near the head. This slot is open at the securing end and the top edge is offset from the bottom edge in the offset direction. As above, the offset decreases from the securing end to the sinker head and the deformation is permanent. In order to hold the deformed sinkers in position, the offset edges of the sinkers are cast in a common block in the offset position.

Alternatively, the respective edges of the sinkers may be cast in two separate blocks and the two blocks can be joined together to obtain the deformation.

In still another embodiment, each sinker may be deformed about a pair of parallel imaginary longitudinal axes. In this embodiment, the direction of the respective bends are opposite to each other such that the top edges and bottom edges are disposed in parallel offset planes. Again, the deformation is permanent.

In still another embodiment, instead of using sinkers which are offset by a permanent deformation, each sinker may have a centrally located slot extending from the securing end to near the head with the slot being open at the securing end. In this case, means are provided for holding the respective edges in offset relation under tension. Alternatively, the respective edges of the sinkers can be cast into separate blocks which, in turn, are subsequently shifted and secured in an offset position. In this case, the offset, besides increasing rigidity, also produces a tension between the top and bottom edges thus further increasing lateral stability.

In still another embodiment, if longitudinally slotted sinkers are used, the top edges can be secured via a cast block to a bar while the bottom edges are secured via a cast block to a separately mounted bar. In order to facilitate overlapping, the bottom bar can be made movable relative to the top bar.

These and other objects and advantages of the invention will become more apparent from the following detailed description and appended claims taken in conjunction with the accompanying drawings in which:

Figure 2:
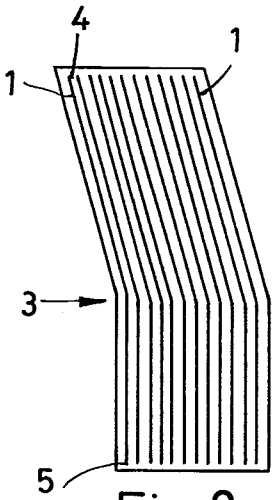
FIG. 2 illustrates a view taken on line II—II of FIG. 1.
Figure 1:
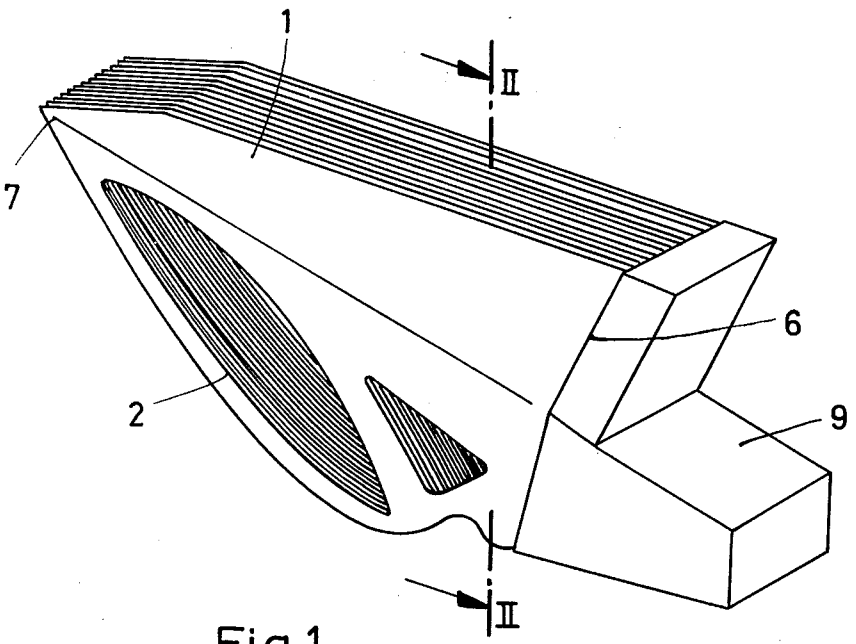
FIG. 1 illustrates a perspective view of a laying-in comb having sinkers thereon in accordance with the invention.

Referring to FIGS. 1 and 2, the laying-in comb is provided with a plurality of spaced apart aligned sinkers 1. Each of the sinkers 1 is formed at the bottom with a thread guide 2 for a warp yarn. The laying-in comb is suitable for use in a warp knitting machine having guide bars (not shown) which are prevented from moving in a swinging direction.

As shown, each sinker 1 is permanently deformed, i.e. bent at an angle, around an imaginary longitudinal axis at the center 3 such that the top edges 4 are offset relative to the bottom edges 5 in the offsetting direction. Each sinker 1 also has a head 7 at one end and a securing end 6 with the respective edges 4, 5 extending between the two ends 7, 6. As indicated in FIG. 1, the offset between the top and bottom edges 4, 5 decreases from the securing end 6 to the head 7.

The laying-in comb also has a block 9 in which the securing ends 6 of the sinkers 1 are integrally cast. As shown in FIG. 1, the laying-in comb is of an integrated one piece construction.

Figure 4:
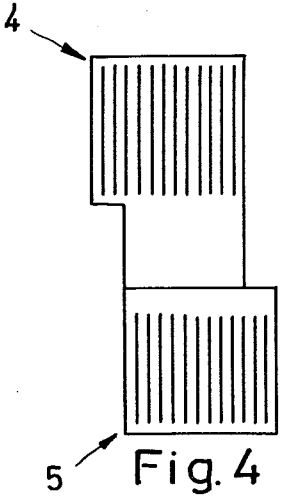
FIG. 4 illustrates a view taken on line IV—IV of FIG. 3.
Figure 3:
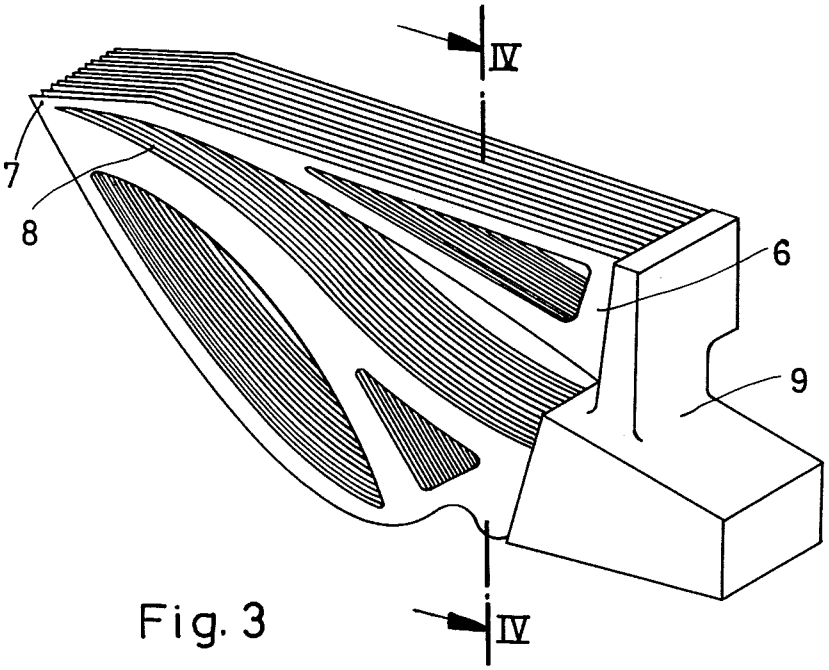
FIG. 3 illustrates a modified laying-in comb having slotted sinkers cast in a block in accordance with the invention.

Referring to FIGS. 3 and 4, wherein like reference characters indicate like parts as above, each sinker of the laying-in comb may have a central slot 8 which extends from the securing end 6 to near the head 7. As shown, each slot 8 is open at the securing end 6 so that the sinker securing end 6 is divided into two parts which are laterally offset from each other and cast into the block 9. As above, the laying-in comb is of integrated one piece construction. Also, as above, the deformation in the sinker 1 is of permanent nature, being introduced during manufacture.

Figure 6:
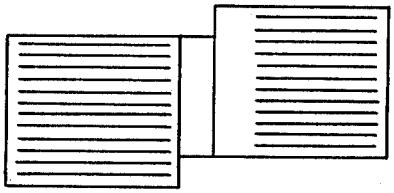
FIG. 6 illustrates a view taken on line VI—VI of FIG. 5.
Figure 5:
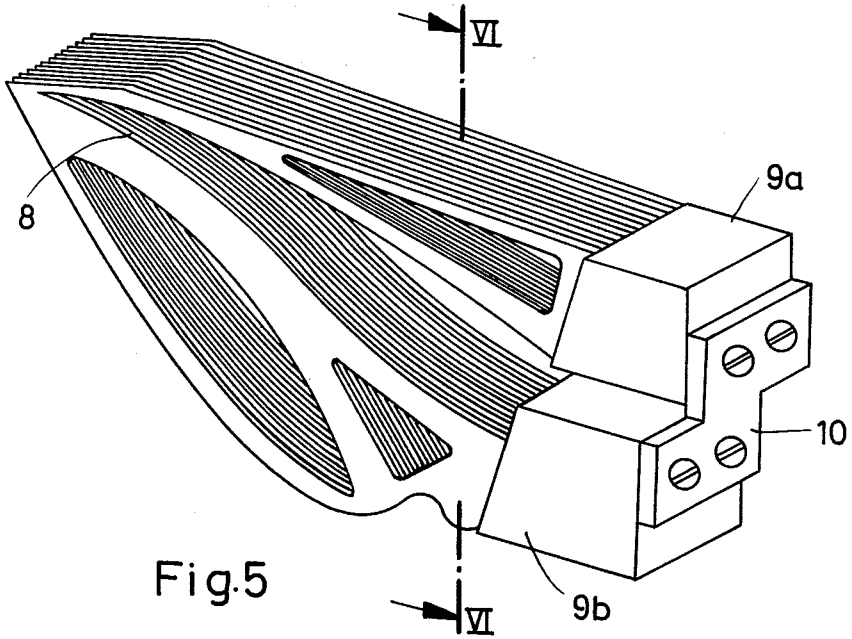
FIG. 5 illustrates a perspective view of a laying-in comb having slotted sinkers cast in two blocks in accordance with the invention.

Referring to FIGS. 5 and 6, wherein like reference characters indicate like parts as above, the deformation of the sinkers need not be permanent. Specifically, each sinker may be provided with a central slot 8 as above with the separated portions of the securing ends cast into two separate blocks *9a*, *9b* respectively. These blocks *9a*, *9b* may be subsequently laterally offset from each other and secured by a suitable means such as a retaining bracket 10 for holding blocks *9a*, *9b* and thus the top and bottom edges 3, 4 in offset relation. In this case, the edges 3, 4 on the sinkers are held under tension.

This construction can be made using initially flat sinkers which become offset upon shifting of the blocks *9a*, *9b*.

Figure 8:
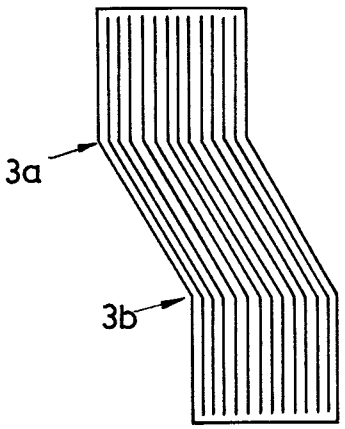
FIG. 8 illustrates a view taken on line VIII—VIII of FIG. 7.
Figure 7:
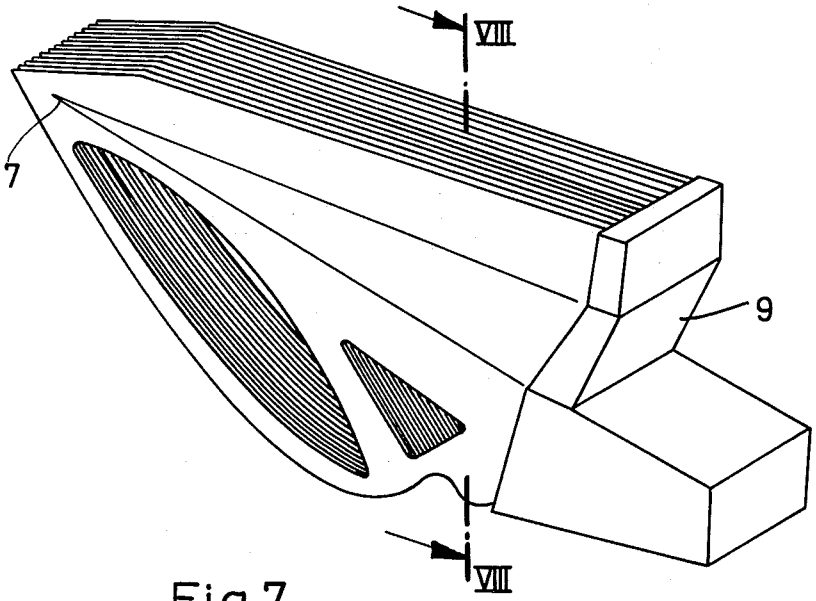
FIG. 7 illustrates a view of a modified laying-in comb having sinkers which are bent about a pair of imaginary axes in accordance with the invention.

Referring to FIGS. 7 and 8, wherein like reference characters indicate like parts as above, the sinkers may be cast in a common block 9 and may be bent about a pair of imaginary longitudinal axes at two bends *3a*, *3b*. As shown in FIG. 8, the sinkers are bent to one side around the top axis *3a* and to the other side about the bottom axis *3b*. As above, the angle then decreases toward the sinker head 7 from a securing end.

Figure 9:
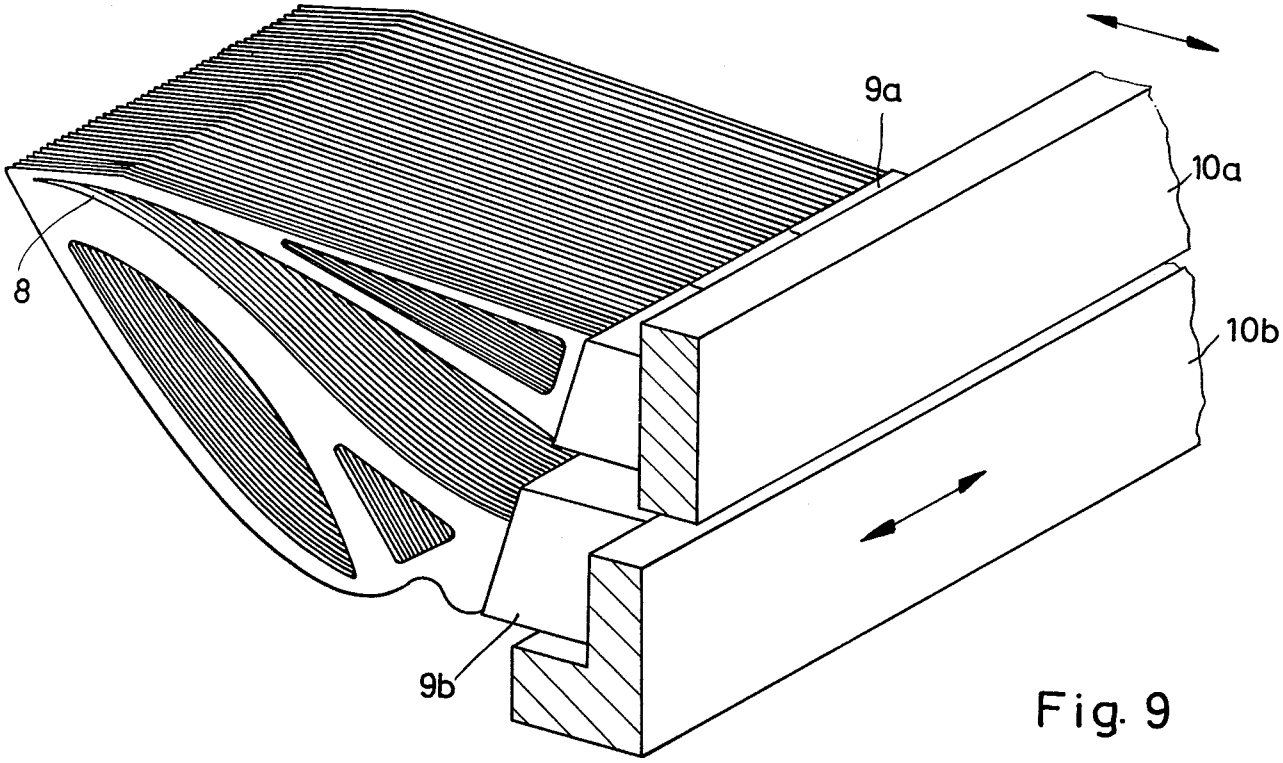
FIG. 9 illustrates a further modified laying-in comb having slotted sinkers disposed in cast blocks secured to reciprocating bars in accordance with the invention.

Referring to FIG. 9, wherein like reference characters indicate like parts as above, the laying-in comb may have sinkers similar to those illustrated in FIG. 5 with the top and bottom parts of the securing ends secured in separate blocks *9a*, *9b*. In addition, the blocks *9a*, *9b* are secured to separably mounted bars *10a*, *10b* which extend perpendicularly of the blocks *9a*, *9b*. These bars *10a*, *10b* are mounted so that one is movable relative to the other, for example in accordance with a pattern. Thus, the amount of offset between the top and bottom edges of the sinkers can be adjusted according to the pattern.

The invention thus provides a laying-in comb wherein the sinkers are deformed either permanently or temporarily in order to increase lateral stability.

It is noted that it is often advantageous to combine the various characteristics of the various embodiments described above. For example, in the comb of FIG. 9 where the sinkers are under tension, the sinker portion above the central slot 8 can be longitudinally curved, bent at an angle or formed with beads.

Further, the invention is not restricted to the illustrated means of securing the sinkers. For example, instead of casting the securing ends of the sinkers, the individual sinkers can be combined into a set by other means, for example by means of a tie rod and intermediate members.

Finally, a minor point, the sinkers can be offset by an amount equal to one or more needle spacings.

What is claimed is:

1. A laying-in comb for warp knitting machines, said comb having a plurality of spaced apart aligned sinkers, each said sinker having a head at one end, a securing end at the opposite end, a top edge extending between said ends, and a bottom edge longitudinally offset from said top edge at least at said securing end, said offset decreasing from said securing end to said head.

2. A laying-in comb as set forth in claim 1 wherein each sinker is permanently deformed around an imaginary longitudinal axis.

3. A laying-in comb as set forth in claim 2 wherein each sinker is permanently curved about said axis.

4. A laying-in comb as set forth in claim 2 wherein each sinker is permanently bent about said axis.

5. A laying-in comb as set forth in claim 1 wherein each sinker has a centrally located slot extending from said securing end to near said head, said slot being open at said securing end and wherein said top edge is offset from said bottom edge in a shogging direction at said securing end.

6. A laying-in comb as set forth in claim 5 which further includes a block having said offset edges of a plurality of closely spaced sinkers cast therein.

7. A laying-in comb as set forth in claim 5 which further includes a first block having said top edges of a plurality of closely spaced sinkers cast therein, and a second block having said bottom edges of said plurality of sinkers cast therein, said blocks being interconnected to each other to offset said top edges from said bottom edges.

8. A laying-in comb as set forth in claim 1 wherein each sinker is deformed about a pair of imaginary longitudinal axes.

9. A laying-in comb as set forth in claim 1 wherein each sinker has a centrally located slot extending from said securing end to near said head, said slot being open at said securing end and wherein said top edge is offset from said bottom edge under tension and which further includes means for holding said edges in offset relation.

10. A laying-in comb as set forth in claim 1 wherein each sinker has a centrally located slot extending from said securing end to near said head, said slot being open at said securing end and wherein said top edge is offset from said bottom edge and which further includes a first block having said top edges of a plurality of closely spaced sinkers cast therein, and a second block having said bottom edges of said plurality of sinkers cast therein, a first bar secured to said first block and a second bar secured to said second block, said bars being disposed in offset relation to each other.

11. A laying-in comb as set forth in claim 1 wherein one of said bars is moveable relative to the other of said bars.

12. A laying-in comb as set forth in claim 1 wherein each sinker has a yarn guide therein.

13. A laying-in comb as set forth in claim 12 wherein said yarn guide is an elongated longitudinal slot.

14. A laying-in comb as set forth in claim 13 wherein each sinker is permanently deformed around an imaginary longitudinal axis and said elongated slot is disposed below said axis.

* * * * *